US008910488B2

(12) United States Patent
Fung

(10) Patent No.: US 8,910,488 B2
(45) Date of Patent: Dec. 16, 2014

(54) DISPLAY CASE INCLUDING HEAT EXCHANGER FOR REDUCING RELATIVE HUMIDITY

(75) Inventor: Kwok Kwong Fung, Granger, IN (US)

(73) Assignee: Hill Phoenix, Inc., Conyers, GA (US)

( * ) Notice: Subject to any disclaimer, the term of this patent is extended or adjusted under 35 U.S.C. 154(b) by 568 days.

(21) Appl. No.: 12/675,710

(22) PCT Filed: Sep. 28, 2007

(86) PCT No.: PCT/US2007/079853

§ 371 (c)(1),
(2), (4) Date: Feb. 26, 2010

(87) PCT Pub. No.: WO2009/041976

PCT Pub. Date: Apr. 2, 2009

(65) Prior Publication Data

US 2010/0236752 A1 Sep. 23, 2010

(51) Int. Cl.
*F25D 17/06* (2006.01)
*A47F 3/04* (2006.01)

(52) U.S. Cl.
CPC ..... *A47F 3/0443* (2013.01)
USPC ..... 62/90; 62/256; 62/277

(58) Field of Classification Search
CPC ..... F25D 17/06; F25D 21/04; A47F 3/0447; F25B 47/02; F25B 39/028
USPC ..... 62/90, 256, 277–278, 93
See application file for complete search history.

(56) References Cited

U.S. PATENT DOCUMENTS

| | | | | |
|---|---|---|---|---|
| 6,382,310 | B1 * | 5/2002 | Smith | 165/121 |
| 6,612,119 | B2 * | 9/2003 | Eber et al. | 62/90 |
| 7,231,778 | B2 | 6/2007 | Rigney et al. | |
| 7,779,898 | B2 * | 8/2010 | Morrison et al. | 165/150 |

FOREIGN PATENT DOCUMENTS

WO WO2007/061420 A1 5/2007

OTHER PUBLICATIONS

International Search Report and Written Opinion for International Application No. PCT/US2007/079853, mail date Mar. 24, 2008, 6 pages.

* cited by examiner

*Primary Examiner* — Lakiya Rogers
(74) *Attorney, Agent, or Firm* — Foley & Lardner LLP

(57) ABSTRACT

A refrigerated case includes a housing including an interior display volume and a heat exchanger. The heat exchanger includes a circuit defined by a heat exchanger section including a plurality of tubes that define a flow path, a reheat section including a reheat tube, and a connecting tube fluidly connecting the flow path of the heat exchanger section with the reheat tube. Air flows over the plurality of tubes of the heat exchanger section and rejects heat to a refrigerant flowing through the plurality of tubes to heat the refrigerant. The heated refrigerant then flows through the reheat tube. As the air passes over the reheat tube, the air accepts heat from the heated refrigerant flowing through the reheat tube.

15 Claims, 2 Drawing Sheets

DISPLAY CASE INCLUDING HEAT EXCHANGER FOR REDUCING RELATIVE HUMIDITY

BACKGROUND OF THE INVENTION

The present invention relates generally to a display case including a heat exchanger that reduces the relative humidity of air exiting the heat exchanger.

Refrigerated food and beverage display cases are commonly used in grocery stores or supermarkets to cool refrigerated products and present the products to customers in an appealing manner. A heat exchanger cools the air in the display case, and a fan system generates an air curtain that cools the products in the display case. If the relative humidity of the air exiting the heat exchanger is too high, moisture can condense on the packaging of the products, possibly affecting the structural integrity of the packaging.

Hence, there is need in the art for a display case including a heat exchanger that reduces the relative humidity of air exiting the heat exchanger and that overcomes the drawbacks and shortcomings of the prior art.

SUMMARY OF THE INVENTION

A display case cools products and presents the products to customers in an appealing manner. A heat exchanger cools air in the display case to a desired temperature, and a fan system circulates the cooled air through the display case to cool the products to a desired temperature. If warm ambient air enters an interior display volume of the display case, localized condensation on the products can occur.

The heat exchanger includes a circuit defined by a heat exchanger section including a plurality of tubes that define a flow path, a reheat section including a reheat tube, and a connecting tube fluidly connecting the flow path of the heat exchanger section with the reheat tube. Air flows over the plurality of tubes of the heat exchanger section and rejects heat to a refrigerant flowing through the plurality of tubes to heat the refrigerant. The heated refrigerant then flows through the reheat tube. As the air passes over the reheat tube, the air accepts heat from the heated refrigerant flowing through the reheat tube.

As the air flows over the reheat tube, the warmed refrigerant slightly warms the air, raising the dew point of the air and lowering the relative humidity of the air exiting the heat exchanger. The lower relative humidity air has more capacity to remove any moisture that might have been deposited inside the interior display volume, preventing localized condensation on the products.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
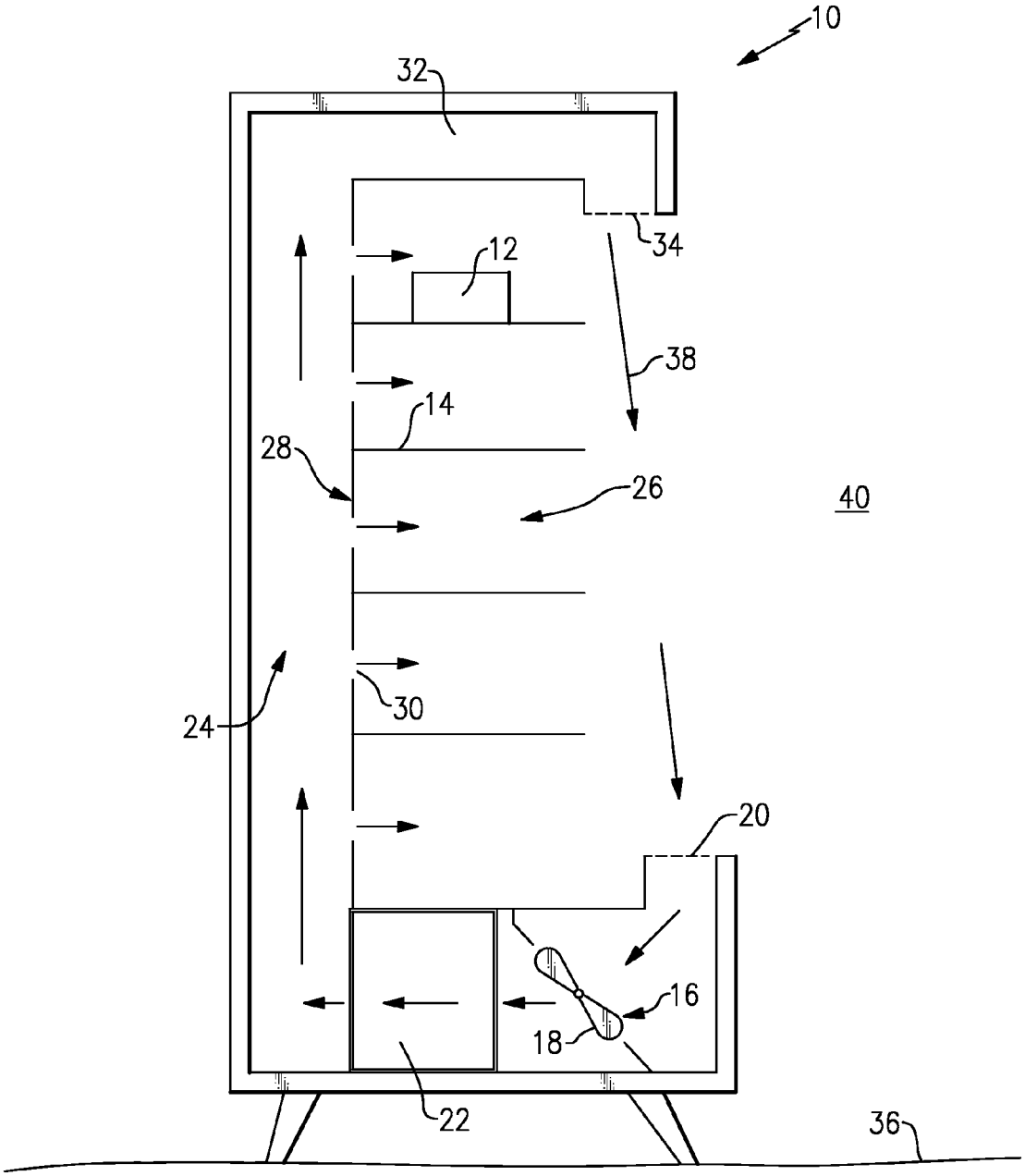
FIG. 1 schematically illustrates a side view of a display case.

FIG. 1 illustrates a supermarket display case 10 or merchandiser. The display case 10 cools or refrigerates products 12 and presents the products 12 to customers in an appealing manner. The products 12 can be produce, dairy products, meat products, or any other refrigerated product. The display case 10 includes shelves 14 that hold the products 12. The products 12 are housed in an interior display volume 26 of the display case 10.

A fan system 16 circulates cool air through the display case 10 to cool the products 12 to a desired temperature. The fan system 16 includes a fan 18 located at a bottom front of the display case 10. The fan 18 draws air through a return grille 20 and into a heat exchanger 22.

The air 64 drawn into the heat exchanger 22 by the fan 18 is approximately 41° F. The air 64 flows through the heat exchanger 22 (which is part of a chiller system also including a compressor, not shown) that cools the air 64 to a desired temperature, usually approximately 30 to 31° F. The air 64 exchanges heat with a refrigerant flowing through the heat exchanger 22 to cool the air 64 and therefore the product 12. The air 64 flows in a generally horizontal direction through the heat exchanger 22. In one example, the refrigerant is a secondary heat transfer fluid, such as a glycol/water solution. In one example, the secondary heat transfer fluid is a non-evaporative fluid.

After exiting the heat exchanger 22, the cooled air then flows upwardly in a generally vertical direction through a rear duct 24. The rear duct 24 is separated from the interior display volume 26 by a rear duct panel 28. Part of the air moving up the rear duct 24 also diffuses into the interior display volume 26 through holes 30 in the rear duct panel 28 and flows in a generally horizontal direction to help refrigerate the products 12 in the interior display volume 26.

The air then flows generally horizontally through an upper conduit 32 to an upper front of the display case 10. The air flows through a discharge grille 34 and is discharged downwardly and generally vertically towards a floor 36 to form an air curtain 38. The air curtain 38 cools the products 12 in the display case 10, separating the interior display volume 26 from ambient air 40 external to the display case 10. Typically, the ambient air 40 is approximately 70-75° F. The air then flows through the return grille 20 and into the fan system 16, completing the air circulation cycle.

As the air 64 flows though the heat exchanger 22, it exchanges heat with a refrigerant flowing through the heat exchanger 22. When a high efficiency heat exchanger 22 is employed, the air 64 exiting the heat exchanger 22 approaches the temperature of the refrigerant in the heat exchanger 22. This can especially occur in the winter, when the temperature of the ambient air 40 in the store is lower (for example, to save on heating costs of the store). This reduces the loading on the heat exchanger 22, causing the heat exchanger 22 to be oversized. The relative humidity of the air 64 exiting the heat exchanger 22 approaches 100%.

If any of the products 12 protrude into and disrupt the air curtain 38, the warm ambient air 40 can migrate into the interior display volume 26. The dew point of the outside air is usually significantly higher than the temperature inside the display case 10. If the ambient air 40 mixes with the cold air inside the display case 10, the ambient air 40 drops below its dew point. The air 64 that is just exiting the heat exchanger 22 inside the display case 10 is already close to saturation, and the air in the display case 10 has little capacity to absorb the moisture separated from the ambient air 40.

Localized condensation can form on the products 12 and the shelves 14 in the display case 10. If the products 12 have cardboard packaging, the packaging can absorb the moisture condensed on its surface and become soggy over time, causing the packaging to lose its structural integrity and break down when handled.

Figure 2:
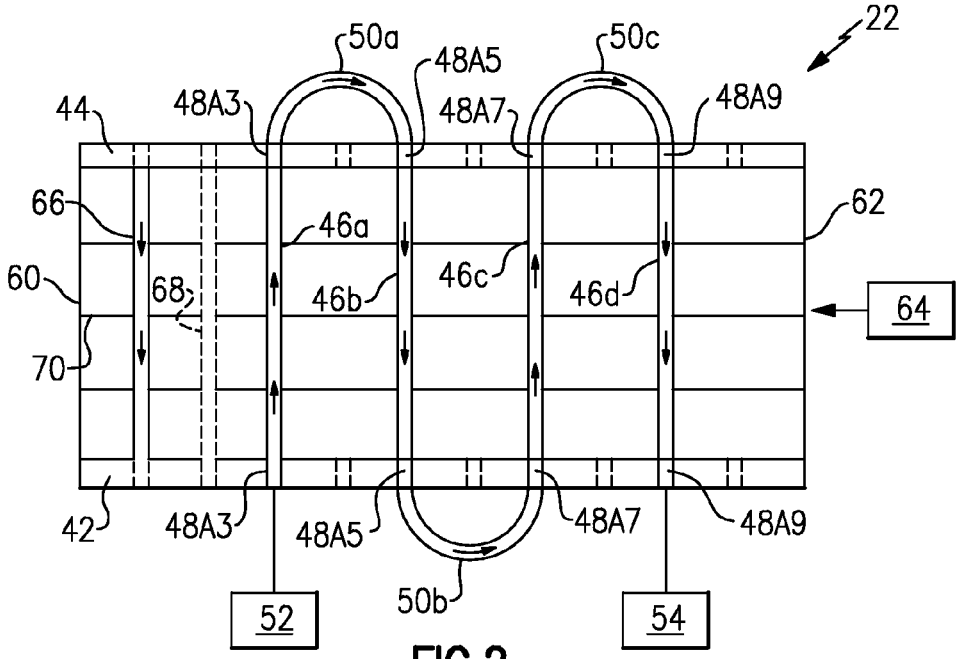
FIG. 2 schematically illustrates a top view of a circuit of a heat exchanger.

FIG. 2 illustrates a schematic top view of the heat exchanger 22 showing only one row of tubes 46 (for example, row A as described below). The heat exchanger 22 includes plates 42 and 44 and a plurality of tubes 46 extending between the plates 42 and 44. The plates 42 and 44 each include a plurality of holes 48 that receive the plurality of tubes 46. The plurality of tubes 46 extend generally perpendicular to the direction of the airflow. The heat exchanger 22 also includes a plurality of fins 70 that increase heat transfer. In one example, there are six fins 70 per inch.

The temperature of the refrigerant entering the heat exchanger 22 is approximately 25-27° F., and the temperature of the refrigerant exiting the heat exchanger 22 is approximately 28 to 31° F. The air 64 flows around the plurality of tubes 46, and the refrigerant flows through the plurality of tubes 46. In one example, the plates 42 and 44 are made of steel, the plurality of tubes 46 are made of copper, and the fins 70 are made of aluminum.

The heat exchanger 22 includes at least one heat exchanger circuit having a heat exchanger section and at least one reheat circuit having a heat exchanger section and a reheat section.

As the air 64 flows through the heat exchanger 22, the air 64 rejects heat to the refrigerant flowing through the plurality of tubes 46 in the heat exchanger section of the heat exchanger 22. In FIG. 2, the air 64 flows from right to left from an inlet side 62 of the heat exchanger 22 to an outlet side 60 of the heat exchanger 22, and the refrigerant flows in an upwardly and downwardly direction through the plurality of tubes 46.

Figure 3:
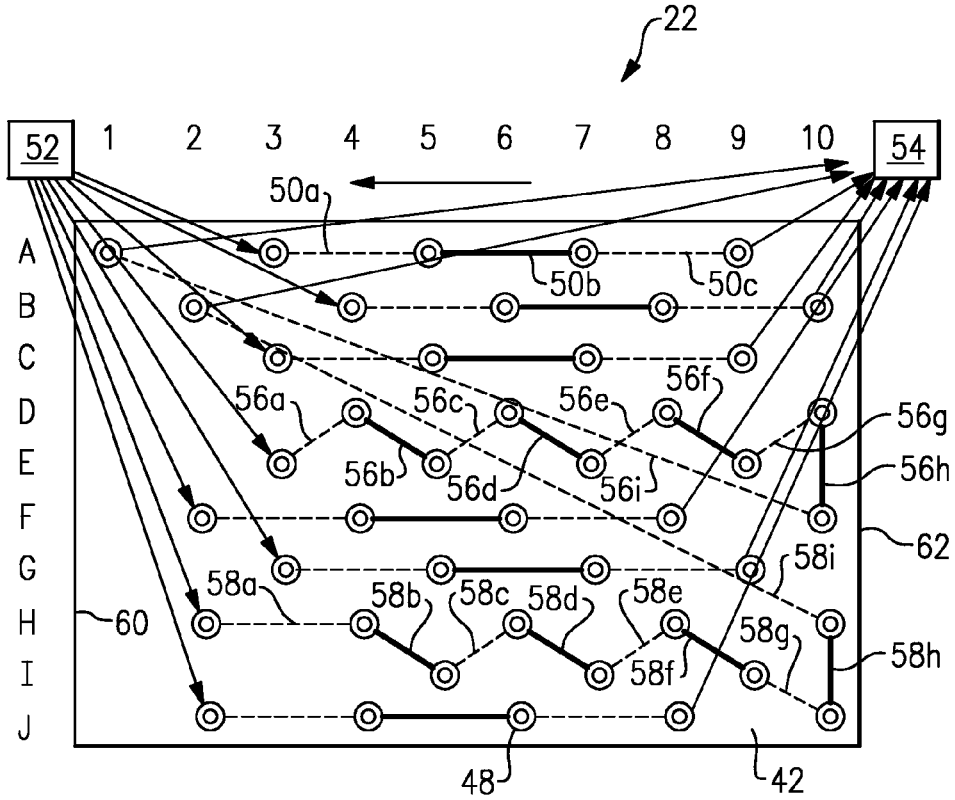
FIG. 3 schematically illustrates a side view of the heat exchanger.

FIG. 3 illustrates a side view of the heat exchanger 22 showing the plate 42 and the configuration of the holes 48. In one example, the plate 42 includes ten rows of holes 48, each row of holes 48 labeled A to J from top to bottom. There are also ten columns of holes 48 labeled 1 to 10 from left to right. Each row includes three to five holes 48. The holes 48 in alternating rows A to J are horizontally staggered from the adjacent row of holes 48. The holes 48 in the below description are labeled by the corresponding row and column.

Returning to FIG. 2, the tubes 46*a*, 46*b*, 46*c* and 46*d* in row A form one heat exchanger circuit, and the tubes 46*a*, 46*b*, 46*c* and 46*d* are connected by curved u-shaped connecting tubes 50*a*, 50*b* and 50*c*. In FIG. 3, the connecting tubes 50 connected to the tubes 46 near the plate 42 are curved out of the page and are shown as solid lines. The connecting tubes 50 connected to the tubes 46 near the plate 44 are curved into the page and are shown as dashed lines. As the refrigerant flows through the heat exchanger circuit, the refrigerant flows generally perpendicular to the flow of air 64 from the tubes 46 near the outlet side 60 of the heat exchanger 22 to the tubes near the inlet side 62 of the heat exchanger 22.

In row A, refrigerant enters the heat exchanger 22 at 52 and flows in a first direction (into the page of FIG. 3) through a tube 46*a* that extends from the hole 48A3 of the plate 42 to the hole 48A3 of the plate 44. The refrigerant then flows through a connecting tube 50*a* and then flows in a second opposite direction (out of the page of FIG. 3) through a tube 46*b* that extends from the hole 48A5 of the plate 42 to the hole 48A5 of the plate 44. The refrigerant then flows through a connecting tube 50*b* and then flows in the first direction through a tube 46*c* that extends from the hole 48A7 of the plate 42 to the hole 48A7 of the plate 44. The refrigerant then flows through a connecting tube 50*c* and then flows in the second opposite direction through a tube 46*d* that extends from the hole 48A9 of the plate 42 to the hole 48A9 of the plate 44 and exits the heat exchanger 22 at 54. As the refrigerant flows through the circuit defined by the tubes 46*a*, 46*b*, 46*c* and 46*d* in row A, the refrigerant accepts heat from the air 64, cooling the air 64 and heating the refrigerant. In the above-described example, the refrigerant makes four passes through the heat exchanger 22 (through the four tubes 46*a*, 46*b*, 46*c* and 46*d*).

Although only the heat exchanger circuit defined by the tubes 46*a*, 46*b*, 46*c* and 46*d* of row A has been illustrated and described, the tubes 46 in each of the rows B, C, F, G and J can also define a heat exchanger circuit. In one example, the heat exchanger 22 includes six heat exchanger circuits. Refrigerant enters each of the six heat exchanger circuits defined by rows A, B, C, F, G and J at 52, makes four passes through the heat exchanger 22, and exits the heat exchanger 22 at 54.

In one example, the heat exchanger 22 includes two reheat circuits that include both a heat exchanger section and a reheat section. A first reheat circuit primarily uses the holes 48 in rows D and E, and a second reheat circuit primarily uses the holes in rows H and I.

In the first reheat circuit, the refrigerant generally flows back and forth between rows D and E. As the refrigerant flows through the heat exchanger section of the first reheat circuit, the refrigerant moves from the outlet side 60 of the heat exchanger 22 to the inlet side 62 of the heat exchanger 22 generally perpendicular to the air 64 flow.

The refrigerant enters the heat exchanger 22 at 52 and flows through a tube 46 received in the holes 48E3 of the plates 42 and 44. The refrigerant flows through a connecting tube 56*a* connected near the plate 44 and enters a tube 46 received in the holes 48D4 of the plates 42 and 44 and flows towards the plate 42. The refrigerant flows through a connecting tube 56*b* connected near the plate 42 and enters a tube 46 received in the holes 48E5 of the plates 42 and 44 and flows towards the plate 44. The refrigerant flows through a connecting tube 56*c* connected near the plate 44 and enters a tube 46 received in the holes 48D6 of the plates 42 and 44 and flows towards the plate 42. The refrigerant flows through a connecting tube 56*d* connected near the plate 42 and enters a tube 46 received in the holes 48E7 of the plates 42 and 44 and flows towards the plate 44. The refrigerant flows through a connecting tube 56*e* connected near the plate 44 and enters a tube 46 received in the holes 48D8 of the plates 42 and 44 and flows towards the plate 42. The refrigerant flows through a connecting tube 56*f* connected near the plate 42 and enters a tube 46 received in the holes 48E9 of the plates 42 and 44 and flows towards the plate 44. The refrigerant flows through a connecting tube 56*g* connected near the plate 44 and enters a tube 46 received in the holes 48D10 of the plates 42 and 44 and flows towards the plate 42. The refrigerant then flows through a connecting tube 56h connected near the plate 42 and enters a tube received in the holes 48F10 of the plates 42 and 44 and flows towards the plate 44.

As the refrigerant flows through the heat exchanger section of the first reheat circuit of the heat exchanger 22 from the outlet side 60 to the inlet side 62, the refrigerant is heated. The heated refrigerant then flows through a jumper 56i that flows the refrigerant to a reheat tube 66 (shown in FIG. 2) in the reheat section that is received in the holes 48A1 of the plates 42 and 44 near the outlet side 60 of the heat exchanger 22. The refrigerant exits the heat exchanger 22 at 54.

In the second reheat circuit, the refrigerant generally flows back and forth between rows H and I. As the refrigerant flows through the second reheat circuit, the refrigerant moves from the outlet side 60 of the heat exchanger 22 to the inlet side 62 of the heat exchanger 22.

The refrigerant enters the heat exchanger 22 at 52 and flows through a tube 46 received in the holes 48H2 of the plates 42 and 44. The refrigerant flows through a connecting tube 58a connected near the plate 44 and enters a tube 46 received in the holes 48H4 of the plates 42 and 44 and flows towards the plate 42. The refrigerant flows through a connecting tube 58b connected near the plate 42 and enters a tube 46 received in the holes 4815 of the plates 42 and 44 and flows towards the plate 44. The refrigerant flows through a connecting tube 58*c* connected near the plate 44 and enters a tube 46 received in the holes 48H6 of the plates 42 and 44 and flows towards the plate 42. The refrigerant flows through a connecting tube 58*d* connected near the plate 42 and enters a tube 46 received in the holes 4817 of the plates 42 and 44 and flows towards the plate 44. The refrigerant flows through a connecting tube 58*e* connected near the plate 44 and enters a tube 46 received in the holes 48H8 of the plates 42 and 44 and flows towards the plate 42. The refrigerant flows through a connecting tube 58f connected near the plate 42 and enters a tube 46 received in the holes 4819 of the plates 42 and 44 and flows towards the plate 44. The refrigerant flows through a connecting tube 58g connected near the plate 44 and enters a tube 46 received in the holes 48J10 of the plates 42 and 44 and flows towards the plate 42. The refrigerant then flows through a connecting tube 58*h* connected near the plate 42 and enters a tube 46received in the holes 48H10 of the plates 42 and 44 and flows towards the plate 44.

As the refrigerant flows through the heat exchanger section of the second reheat circuit of the heat exchanger 22 from the outlet side 60 to the inlet side 62, the refrigerant is heated. The heated refrigerant then flows through a jumper 58*i* that flows the refrigerant to a reheat tube 68 (shown in FIG. 2) in the reheat section that is received in the holes 48B2 of the plates 42 and 44 near the outlet side 60 of the heat exchanger 22. The refrigerant exits the heat exchanger 22 at 54.

As the refrigerant flows through the heat exchanger 22 and travels in the tubes 46 from the outlet side 60 of the heat exchanger 22 to the inlet side 62 of the heat exchanger 22, the refrigerant is heated as it accepts heat from the air 64 and flows through the heat exchanger circuits and the heat exchanger section of the reheat circuits. When the refrigerant in the heat exchanger sections reaches the tubes 46 near the inlet side 62 of the heat exchanger 22, the refrigerant is the warmest as it has absorbed heat from the air 64 flowing through the heat exchanger 22. The refrigerant then travels through the jumpers 56*i* and 58*i* and flows through the reheat tubes 46 in the reheat section of the reheat circuit that are received in the holes 48A1 and 48B2.

When the air 64 passes over the reheat tubes 66 and 68 received in the holes 48A1 and 48B2 of the plates 42 and 44 that contains the higher temperature refrigerant, the air 64 is slightly warmed by the heated refrigerant before it exits the heat exchanger 22, increasing the dry bulb temperature the air 64 and lowering the relative humidity of the air 64. The lower relative humidity air 64 can thus have more capacity to remove any moisture that had been deposited inside the interior display volume 26, preventing localized condensation onto the merchandise surfaces when additional moisture is introduced. Therefore, the condensation absorption capability of the air 64 is improved. The additional refrigerant pass through the reheat tubes 66 and 68 increases the temperature of the refrigerant by approximately 0.5° F. or more. This small increase in refrigerant temperature increases the exit temperature of the air 64, reducing the relative humidity from 100% to approximately 94% or lower.

Different configurations of heat exchanger circuits and reheat circuits are possible. That is, the circuit configuration can be changed based on the required application.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A refrigerated case comprising:

a housing including an interior display volume; and a heat exchanger including a plurality of heat exchanger circuits that define a first number of tube passes, and at least one reheat circuit that defines a second number of tube passes, the second number of tube passes being greater than the first number of tube passes wherein the refrigerant in the at least one reheat circuit heated to a higher temperature than refrigerant in the heat exchanger circuits, the heat exchanger also including at least one reheat tube, and a connecting tube fluidly connecting the at least one reheat circuit with the at least one reheat tube, wherein the higher temperature refrigerant flows from the at least one reheat circuit of the heat exchanger section, through the connecting tube and then through the reheat tube, wherein an airflow flows over the plurality of heat exchanger circuits and the at least one reheat circuit and rejects heat to a refrigerant flowing therethrough to heat the refrigerant, and the airflow accepts heat from the higher temperature refrigerant that flows through the at least one reheat tube.

2. The refrigerated case as recited in claim 1 wherein a fan draws the airflow into the heat exchanger, and the airflow from the heat exchanger is directed upwardly through a rear duct, horizontally through an upper conduit and then downwardly to form an air curtain.

3. The refrigerated case as recited in claim 2 wherein a rear duct panel separates the rear duct from the interior display volume, the rear duct panel including a plurality of holes, and the air flowing through the rear duct diverges and flows through the plurality of holes in a generally horizontal direction.

4. The refrigerated case as recited in claim 1 wherein the heat exchanger includes two plates, the first number of tube passes and the second number of tube passes and the at least one reheat tube extend between the plurality of plates, and generally perpendicular to the airflow.

5. The refrigerated case as recited in claim 1 wherein the airflow enters the heat exchanger through an inlet side and exits the heat exchanger through an outlet side, and the refrigerant flows from the outlet side to the inlet side as the refrigerant accepts heat from the airflow.

6. The refrigerated case as recited in claim 5 wherein the at least one reheat tube is positioned near the outlet side of the heat exchanger, and the airflow accepts heat from the heated refrigerant flowing through the at least one reheat tube before exiting the heat exchanger through the outlet side.

7. The refrigerated case as recited in claim 1 wherein the refrigerant is a solution comprising at least one of glycol and water.

8. The refrigerated case as recited in claim 1 wherein the first number of tube passes is four and the second number of tube passes is eight.

9. The refrigerated case as recited in claim 1 wherein the plurality of first circuits are each arranged in a planar configuration and the at least one second circuit is arranged in a non-planar configuration.

10. The refrigerated case as recited in claim 9 wherein each of the plurality of heat exchanger circuits includes a first tube, a second tube, a third tube and a fourth tube, and the first tube and the second tube are connected with a first u-shaped connecting tube, the second tube and the third tube are connected with a second u-shaped connecting tube, and the third tube and the fourth tube are connected with a third u-shaped connecting tube.

11. The refrigerated case as recited in claim 1 wherein the refrigerant flows through the at least one reheat circuit, directly to the connecting tube, and then directly to the at least one reheat tube.

12. The refrigerated case as recited in claim 1 wherein the at least one reheat tube is disposed proximate an airflow outlet of the heat exchanger, and the connecting tube has a first end fluidly coupled to the at least one reheat circuit proximate an airflow inlet of the heat exchanger and a second end fluidly coupled to the reheat tube proximate the airflow outlet.

13. The refrigerated case as recited in claim 1 wherein the airflow first flows over the plurality of heat exchanger circuits and the at least one reheat circuit and then flows over the at least one reheat tube.

14. A refrigerated case comprising:

a housing including an interior display volume;

a fan that draws an airflow into a heat exchanger; and the heat exchanger including a plurality of heat exchanger circuits that define a first number of tube passes, and at least one reheat circuit that defines a second number of tube passes, the second number of tube passes being greater than the first number of tube passes wherein the refrigerant in the at least one heated to a higher temperature than refrigerant in the heat exchanger circuits, the heat exchanger also including at least one reheat tube, and a connecting tube fluidly connecting the at least one reheat circuit with the at least one reheat tube, wherein the higher temperature refrigerant flows from the at least one reheat circuit, through the connecting tube and then through the reheat tube, wherein the airflow flows over the plurality of heat exchanger circuits and the at least one reheat circuit from an inlet side of the heat exchanger to an outlet side of the heat exchanger and rejects heat to a refrigerant flowing therethrough to heat the refrigerant, and wherein the at least one reheat tube is positioned near the outlet side of the heat exchanger, and the airflow accepts heat from the higher temperature refrigerant from the at least one reheat circuit that flows through the reheat tube before exiting the heat exchanger through the outlet side.

15. A method of cooling a display case, the method comprising the steps of:

directing an airflow through a heat exchanger, where the heat exchanger includes a plurality of heat exchanger circuits that define a first number of tube passes, and at least one reheat circuit that defines a second number of tube passes, the second number of tube passes being greater than the first number of tube passes so that refrigerant in the at least one reheat circuit is heated to a higher temperature than refrigerant in the heat exchanger circuit, the heat exchanger is also including at least one reheat tube, and a connecting tube fluidly connecting the at least one reheat circuit with the at least one reheat tube, wherein the higher temperature refrigerant flows from the at least one reheat circuit, through the connecting tube and then through the reheat tube;

exchanging heat between the airflow and a refrigerant in the heat exchanger circuits and the at least one reheat circuit to heat the refrigerant and cool the air in the heat exchanger;

exchanging heat between the airflow and the higher temperature refrigerant from the at least one reheat circuit in the at least one reheat tube to heat the airflow prior to exiting the heat exchanger; and directing the airflow into an interior display volume of the display case.

* * * * *

UNITED STATES PATENT AND TRADEMARK OFFICE

CERTIFICATE OF CORRECTION

PATENT NO. : 8,910,488 B2
APPLICATION NO. : 12/675710
DATED : December 16, 2014
INVENTOR(S) : Kwok Kwong Fung It is certified that error appears in the above-identified patent and that said Letters Patent is hereby corrected as shown below:

IN THE CLAIMS

Column 7:

Line 41, please insert --reheat circuit is-- before "heated to a higher"

Signed and Sealed this
Ninth Day of June, 2015

Michelle K. Lee

Michelle K. Lee
*Director of the United States Patent and Trademark Office*